US007540247B2

(12) United States Patent
Kinley

(10) Patent No.: US 7,540,247 B2
(45) Date of Patent: Jun. 2, 2009

(54) PRINTER RIBBON WITH SEWN FEATURE AND APPARATUS FOR FORMING SAME

(75) Inventor: John S. Kinley, Costa Mesa, CA (US)

(73) Assignee: Printronix, Inc., Irvine, CA (US)

( * ) Notice: Subject to any disclaimer, the term of this patent is extended or adjusted under 35 U.S.C. 154(b) by 403 days.

(21) Appl. No.: 11/451,991

(22) Filed: Jun. 13, 2006

(65) Prior Publication Data

US 2007/0003349 A1 Jan. 4, 2007

Related U.S. Application Data

(60) Provisional application No. 60/692,198, filed on Jun. 17, 2005.

(51) Int. Cl.
*D05B 35/08* (2006.01)
*B41J 33/40* (2006.01)
*B41J 31/09* (2006.01)

(52) U.S. Cl. ..... 112/475.08; 112/470.33; 400/240.1

(58) Field of Classification Search ..... 112/152, 112/470.14, 470.33, 63, 475.04, 475.08, 112/114, 115, 470.06; 400/240.1
See application file for complete search history.

(56) References Cited

U.S. PATENT DOCUMENTS 554,706 A * 2/1896 Manvell ..... 400/239
1,387,034 A * 8/1921 Barron et al. ..... 112/114
3,130,257 A * 4/1964 Rott ..... 427/97.4
3,313,391 A * 4/1967 Hyjek ..... 400/239
3,941,132 A * 3/1976 Lenaghan ..... 604/377
4,137,856 A * 2/1979 Brauns et al. ..... 112/104
4,157,687 A * 6/1979 Cislak ..... 112/470.33
4,503,789 A * 3/1985 Scholl ..... 112/470.13
4,797,016 A * 1/1989 Lahr ..... 400/237
4,928,609 A * 5/1990 Kawasaki ..... 112/470.09
5,632,214 A * 5/1997 Conley et al. ..... 112/470.06
6,581,755 B1 * 6/2003 Wilke et al. ..... 198/810.03
6,663,175 B2 * 12/2003 Mosquera et al. ..... 297/180.12

* cited by examiner

*Primary Examiner*—Ismael Izaguirre
(74) *Attorney, Agent, or Firm*—Haynes and Boone, LLP.

(57) ABSTRACT

A shaped conductive pattern is located very-close to the top and bottom edges of a print ribbon, e.g., 0.18" or less, where the conductive pattern is sewn using a partially conductive thread, such as 20% steel and 80% polyester. A two-piece clamp used to sew the conductive feature has shaped opening in both pieces, a peripheral groove surrounding the shaped opening and vertical grooves outside peripheral groove in one piece, and a peripheral tongue surrounding the shaped opening and vertical tongues outside the peripheral tongue in the other piece, where the width of the vertical grooves is larger than the width of the peripheral groove.

25 Claims, 2 Drawing Sheets

PRINTER RIBBON WITH SEWN FEATURE AND APPARATUS FOR FORMING SAME

CROSS REFERENCE TO RELATED APPLICATIONS

The present invention claims priority to U.S. Provisional Application Ser. No. 60/692,198, filed Jun. 17, 2005, and which is incorporated by reference in its entirety.

BACKGROUND

1. Field of Invention

The present invention relates to print ribbons and in particular, to features for print ribbons and structures to form such features.

2. Related Art

Line matrix and other types of impact printing systems utilize print ribbons to transfer images, such as letters and characters, onto media or paper. The print ribbons hold ink so that hammers striking the print ribbon can transfer corresponding ink images to the paper. The print ribbon is typically mounted on a hub and spool assembly, where the ribbon is moved across the printing area to another hub and spool assembly. The ribbon continues reversing direction until the ink is sufficiently depleted to replace or re-ink the ribbon. However, in order for a more efficient use of the print ribbon, the ribbon reversal should not occur until the ribbon is at or near its end. This way, more of the ribbon is utilized.

One conventional method of detecting when the end of a ribbon is reached for ribbon reversal is to use a conductive feature, such as a diagonal line, at the ends of the ribbon. Ribbon reversal in a printer occurs when this conductive feature on the ribbon is detected, such as when the conductive feature shorts between two ribbon posts. However, metallized conductive leaders exhibit life problems due to adhesion of the metallized component to the ribbon fabric while sewn metal thread is difficult to work with and expensive.

Therefore, there is a need for a print ribbon feature that overcomes the disadvantages discussed above.

SUMMARY

According to one aspect of the present invention, a print ribbon has a conductive Z-shaped feature at the ends of the ribbon, where the Z-shaped feature is sewn with a partially conductive thread, e.g., 20% steel and 80% polyester (20/80). The Z-shape is very close to the top and bottom edges of the ribbon. In one embodiment, for a one-inch wide ribbon, the Z-shaped feature has a height approximately 0.725 inches (+0.015 inches) and a length approximately 4 inches. The Z-shape feature is stitched using two 20/80 conductive threads with a dual thread lock stitch, i.e., one 20/80 thread on top of the ribbon guided by a needle and one 20/80 thread in a bobbin below the ribbon.

The Z-shape feature is sewn using a ribbon clamp to secure the ribbon during sewing. The ribbon clamp has two opposing pieces, with both pieces having a Z-patterned hole through which a needle can pass during the sewing process. One piece has a peripheral rectangular groove surrounding the z-patterned hole and two parallel grooves on either side of the Z-patterned hole. The other piece has a corresponding rectangular tongue surrounding the Z-patterned whole, which fits into the rectangular groove, and a corresponding pair of parallel tongues on either side of the Z-patterned hole, which fits into the two parallel grooves. The ribbon is clamped between these two portions, which stretches and holds the ribbon firmly in place during the conductive thread sewing. This type of clamp enables the Z-pattern to be sewn very closely to the edges of the ribbon.

The Z-patterned conductive feature of the present invention provides numerous advantages over conventional ribbon conductive features. The Z-shape provides redundant electrical paths, i.e., the diagonal and the top and bottom lines for better printer contact for end-of-ribbon detection. Redundant electrical paths decrease net switching resistance due to electrically parallel paths, which includes a low cost second conductive thread in lieu of nonconductive. The Z-shape has a longer lifetime than conventional features due to more distributed conductive material. This increases failure tolerance caused by broken stitches, increases failure tolerance caused by folded or misaligned ribbon, allows alternate points of contact caused by localized ribbon wear, allows cheaper lower conductivity thread blends to be used, and the staggered stitch phasing reduces noise spikes. Further advantages include a decreased switching resistance due to stitch pattern layout. There are higher tension edge zones, which equate to a higher normal contact force. The edge location allows more consistent ribbon life contact force.

The Z-shaped ribbon feature is also highly manufacturable using the clamp of the present invention. The feature can be sewn by standard industrial sewing machines. The rigid clamp maintains the sewing location to allow sewing close to the edges. The outer groove and tongue pairs provide tension to the ends of the fabric during sewing, while the rectangular groove and tongue provides clamping along the edges and tensioning within the feature area.

The cost and difficulty of manufacturing are decreased, while the performance is increased because the feature is sewn with the same thread material at both the top and bottom of the ribbon.

Embodiments of the present invention and their advantages are best understood by referring to the detailed description that follows.

BRIEF DESCRIPTION OF THE DRAWING

It should be appreciated that like reference numerals are used to identify like elements illustrated in one or more of the figures.

DETAILED DESCRIPTION

Figure 1:
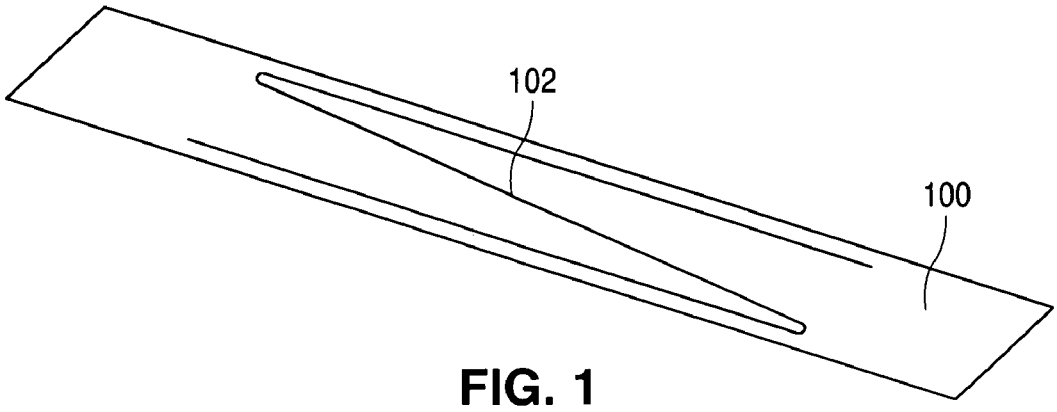
FIG. 1 shows a portion of an end of a print ribbon having the Z-pattern conductive feature according to one embodiment of the present invention.

According to one embodiment of the present invention, a print ribbon has a Z-shape or pattern conductive feature at the ribbon ends for end-of-ribbon detection, as shown in FIG. 1. The Z-shape provides a multiple redundant conductive path for detection. The feature is made with two identical conductive threads having a low amount of conductive material, such as steel. In one embodiment, the thread is a mixture of 20% steel and 80% polyester (20/80). This type of thread is inexpensive and by using two identical such threads costs are reduced and manufacturing is simplified. The Z-shape formed by the two conductive threads is very close to the top and bottom edges of the ribbon, enabling better printer contact to the conductive feature in the high tension ribbon sections.

FIG. 1 shows a portion of a ribbon 100 having a Z-shape or pattern feature 102. In one embodiment, ribbon 100 is a one inch wide ribbon. Z-shape feature 102 is 0.725"±0.015" high, which places the conductive feature very close to the ribbon edges (e.g., less than 0.14"). The length of feature 102 is approximately 4", although other lengths may also be suitable, such as 3.8". In one embodiment, the Z-shape feature is located approximately 14" to 20" from the ends of a 60 or 100 yard 1-inch wide spooled ribbon, with the ribbon attached to the spools by a pressed ball bearing within a couple of inches on each end.

Conductive feature 102 is made of a conductive thread having a percentage of conductive material. In one embodiment, the conductive thread is a blend of 20% steel and 80% polyester by weight (20/80). Other suitable embodiments use a 40/60 blend.

Figure 3:
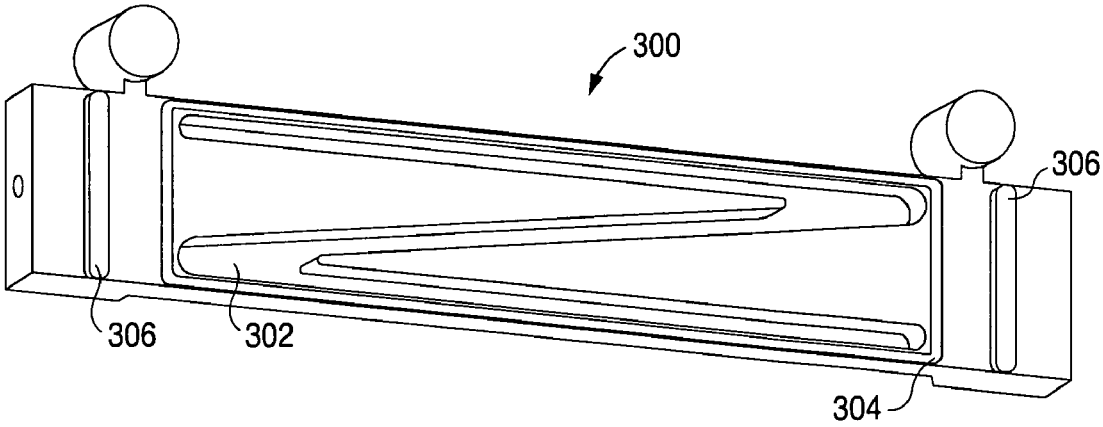
FIG. 3 shows a second opposing portion of the clamp of FIG. 2.
Figure 2:
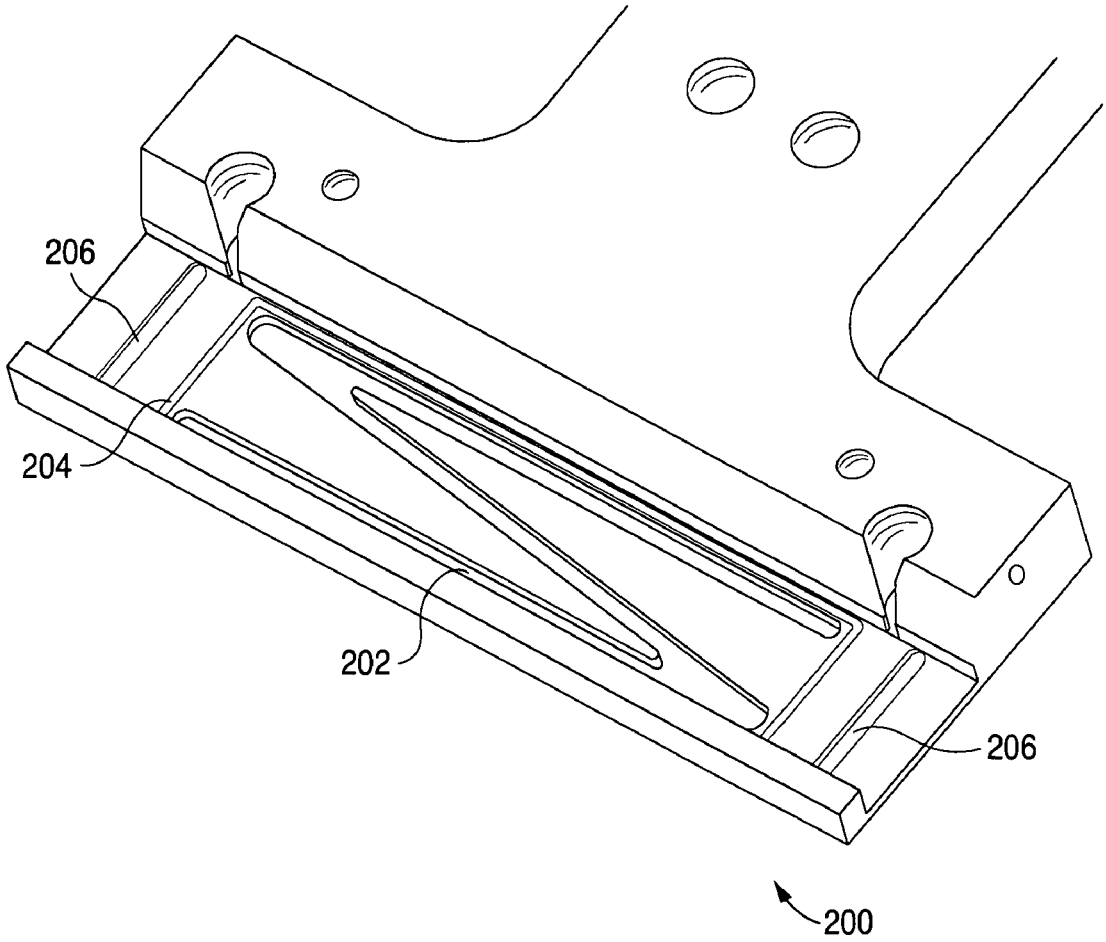
FIG. 2 shows one portion of a clamp for forming the Z-pattern of FIG. 1 according to one embodiment.

FIGS. 2 and 3 show two opposing portions of a clamp that can be used to make the feature of FIG. 1. FIG. 2 shows a first portion 200, e.g., a bottom portion, of the clamp, while FIG. 3 shows a second opposing portion 300, i.e., a top portion, of the clamp. Referring to FIG. 2, first portion 200 includes a Z-shaped opening 202 along a central portion of first portion 200. In one embodiment, opening 202 has a width along the diagonal portion and the top and bottom portions of approximately 0.115", with the Z-shape feature having a height of approximately 0.830". First portion 200 also includes a first groove 204 having a peripheral rectangular shape surrounding Z-shaped opening 202. In one embodiment, first groove 204 has a diameter of approximately 0.625". A single second groove 206, wider than first groove 204, is located on each side of first groove 204. First and second grooves 204 and 206 are used to hold the ribbon in place when sewing the conductive feature, as will be discussed below.

Referring to FIG. 3, second portion 300 also has a Z-shaped opening 302 along a central portion of second portion 300. The Z-shaped opening is the same as Z-shaped opening 202 of first portion 200, i.e., the size of the opening and the height and length of the feature are approximately the same as the opening in first portion 200. Second portion 300 has a first tongue 304 with a peripheral rectangular shape surrounding Z-shaped opening 302. The dimensions of first tongue 304 are the same as the dimension of first groove 204. In other words, first tongue 304 fits into first groove 204. Note that the width of first tongue 304 is smaller than the width of first groove 204 so that the ribbon can be clamped between the groove and tongue, but not so small that the ribbon slips between the groove and tongue. Second portion 300 also has a second tongue 306 on each side of first tongue 304, with the width of second tongue 306 being larger than first tongue 304. The location of second tongue 306 corresponds to second groove 206 of first portion 200. Second tongue 306 fits into second groove 206 to clamp the ribbon during sewing of the conductive Z-shape feature.

Using a clamp having first and second portions 200 and 300, a ribbon is first placed between the two portions. Second tongue 306 and second groove 206 first engage the ribbon to stretch the ribbon length-wise and apply axial tension during clamping. Then, first tongue 304 and first groove 204 engage the ribbon to apply transverse tensioning, as well as more axial tensioning, during clamping. Once firmly secured and clamped by the first and second tongue/groove features, the ribbon is ready for the Z-shape conductive feature to be sewn.

This type of clamp enables the conductive thread to be sewn very close to the top and bottom edges of the ribbon, e.g., less than 0.14". This is important because it was discovered that the central portion (e.g., the middle 0.8") of the ribbon that was being printed on was wearing, causing a billowing away from contact posts of an end-of-ribbon detecting circuit. This was effectively lowering the contact force at the ribbon posts and assisting failure of the reversal when stitches were centrally located. The edges of the ribbon consequently exhibited the highest tension contact at the posts. Consequently, conductive thread located near the edges provides better contact with the detection circuit and therefore better detection of the end-of-ribbon for ribbon reversal.

One type of sewing that can be used is a dual thread lock stitch, i.e., one thread on top of the ribbon fabric guided by the needle and a second thread in the bobbin below the ribbon fabric. The needle thread is pushed through the fabric, slacked, then looped around the bobbin and its' thread, and finally pulled back out the top of the fabric thereby locking each stitch. In addition to the lock stitch, a standard feature called locked ends, a back-stitch (typically 3 stitches), can be made at the beginning and end of a pattern. In one embodiment, the stitches can be made concurrent with two programmable sewing machine programs, regular end locked Z and a robust vertex locked Z, where each vertex of the Z has lock stitches. The stitch chosen is 10 per inch (or 3.94 per centimeter or 0.394 per mm). Other densities may also be appropriate, such as ranging from 8 to 18 stitches per inch.

In one example for a 1" ribbon, the Z-shape open feature is 0.83" high, leaving 0.170" to clamp or 0.085" on both top and bottom edges. The first tongue and groove is 0.625" in diameter. With a needle width of 0.045" and a Z-opening width of 0.115", the sewn Z height has a maximum of 0.785" (0.830"−2*0.045/2") and a minimum of 0.645" (0.830"−2*0.115"+2*0.045/2"), or an average height of 0.715".

Having thus described embodiments of the present invention, persons skilled in the art will recognize that changes may be made in form and detail without departing from the scope of the invention.

For example, specific dimensions are described for the ribbon and feature; however, other dimensions are also suitable. Further, the conductive thread is described as 20% steel and 80% polyester; however, other materials may also be suitable. Furthermore, the pattern is described as Z-shaped and the peripheral feature is described as rectangular; however, other patterns may be envisioned for both the conductive feature and the clamping feature. Thus the invention is limited only by the following claims.

What is claimed is:

1. A conductive feature on a print ribbon, comprising:

a single first Z-shaped conductive pattern located near one end of the print ribbon for end-of-ribbon detection;

a single second Z-shaped conductive pattern located near a second end of the print ribbon for end-of-ribbon detection, wherein the top and bottom of the first and second Z-shaped conductive patterns are located approximately 0.18" or less from top and bottom edges, respectively, of the print ribbon, and wherein the Z-shaped conductive patterns comprise conductive or partially conductive threads, and wherein each Z-shaped conductive pattern spans from a top portion to a bottom portion of the print ribbon.

2. The feature of claim 1, wherein the Z-conductive patterns comprise a conductive material and a non-conductive material, wherein the conductive material is a metal and the non-conductive material is a plastic.

3. The feature of claim 2, wherein the conductive material is approximately 20% and the non-conductive material is approximately 80%.

4. The feature of claim 1, wherein the first and second Z-shaped conductive patterns are approximately 4" long and approximately 72% of the ribbon width.

5. The feature of claim 4, wherein the print ribbon is approximately 1" wide.

6. The feature of claim 1, wherein the shaped conductive pattern is formed from a pair of the conductive threads.

7. The feature of claim 6, wherein each of the pair of conductive threads connect between the top and bottom of the print ribbon.

8. A method of forming a shaped conductive pattern on a print ribbon, comprising:

clamping an end of the ribbon between two first clamps, wherein the two first clamps are located outside, lengthwise, of an area where the conductive pattern will be formed;

clamping the end of the ribbon between a second clamp, wherein the second clamp is between the two first clamps and encloses the periphery of the area;

providing a conductive thread comprising a conductive material; and sewing the conductive thread into a shaped pattern in the area, wherein the top and bottom of the shaped conductive pattern are located approximately 0.18" or less from top and bottom edges, respectively, of the print ribbon.

9. The method of claim 8, wherein clamping with the two first clamps applies axial tension to the ribbon.

10. The method of claim 8, wherein clamping with the second clamp applies transverse tension and axial tension to the ribbon.

11. The method of claim 8, wherein each of the first clamps comprise two opposing portions extending along the width of the ribbon.

12. The method of claim 9, wherein the two opposing portions comprises a corresponding tongue and groove.

13. The method of claim 8, wherein the second clamp comprises two opposing peripheral portions.

14. The method of claim 13, wherein the two opposing peripheral portions comprise a corresponding tongue and groove.

15. The method of claim 12, wherein the second clamp comprises a peripheral groove and a peripheral tongue.

16. The method of claim 15, wherein the width of the peripheral groove is larger than the width of the linear groove.

17. The method of claim 8, wherein the conductive thread comprises conductive materials and non-conductive materials.

18. The method of claim 17, wherein the conductive material is metal and the non-conductive material is plastic.

19. The method of claim 8, wherein the shaped conductive pattern is approximately 4" long and approximately 72% of the ribbon width.

20. The method of claim 8, wherein the print ribbon is approximately 1" wide.

21. The method of claim 8, wherein the shaped conductive pattern is formed from a pair of the conductive threads.

22. The method of claim 21, wherein each of the pair of conductive threads connect between the top and bottom of the print ribbon.

23. A guide for sewing a conductive feature on a print ribbon, comprising:

a first clamp comprising:

a first Z-shaped opening;

a peripheral groove surrounding the first Z-shaped opening; and two vertical grooves located outside the sides of the peripheral groove; and an opposing second clamp comprising:

a second Z-shaped opening;

a peripheral tongue surrounding the second Z-shaped opening; and two vertical tongues located outside the sides of the peripheral tongue.

24. The guide of claim 23, wherein the vertical grooves have a width larger than the peripheral groove.

25. The guide of claim 23, wherein the second Z-shaped opening is approximately 0.1 inches away from a top and bottom side of the guide.

* * * * *